US009759054B2

(12) United States Patent
Gay et al.

(10) Patent No.: US 9,759,054 B2
(45) Date of Patent: Sep. 12, 2017

(54) SYSTEM AND METHOD FOR UTILIZING INTEGRATED PRESSURE EXCHANGE MANIFOLD IN HYDRAULIC FRACTURING

(71) Applicant: ENERGY RECOVERY, INC., San Leandro, CA (US)

(72) Inventors: Joel Gay, Ramon, CA (US); Farshad Ghasripoor, Berkeley, CA (US); Jeremy Grant Martin, Oakland, CA (US); Adam Rothschild Hoffman, San Francisco, CA (US)

(73) Assignee: ENERGY RECOVERY, INC., San Leandro, CA (US)

( * ) Notice: Subject to any disclaimer, the term of this patent is extended or adjusted under 35 U.S.C. 154(b) by 77 days.

(21) Appl. No.: 14/797,953

(22) Filed: Jul. 13, 2015

(65) Prior Publication Data

US 2016/0032702 A1 Feb. 4, 2016

Related U.S. Application Data

(60) Provisional application No. 62/030,816, filed on Jul. 30, 2014.

(51) Int. Cl.
*E21B 43/26* (2006.01)
*F04B 43/073* (2006.01)
(Continued)

(52) U.S. Cl.
CPC ..... *E21B 43/26* (2013.01); *E21B 43/267* (2013.01); *F04B 43/0736* (2013.01);
(Continued)

(58) Field of Classification Search
CPC ..... F04F 13/00; F04B 43/0736; Y10T 137/86163; Y10T 137/86139
See application file for complete search history.

(56) References Cited

U.S. PATENT DOCUMENTS 3,630,638 A * 12/1971 Huso ..... F04B 1/00 417/12
6,540,487 B2 4/2003 Polizos et al.
(Continued)

FOREIGN PATENT DOCUMENTS

WO 2013/061229 A2 5/2013

OTHER PUBLICATIONS

PCT International Search Report and Written Opinion; Application No. PCT/US2015/040656; Dated Nov. 24, 2015; 13 pages.

*Primary Examiner* — Atif Chaudry
(74) *Attorney, Agent, or Firm* — Fletcher Yoder, P.C.

(57) ABSTRACT

A system includes an integrated manifold system including multiple isobaric pressure exchangers (IPXs) that each includes a low-pressure first fluid inlet, a high-pressure second fluid inlet, a high-pressure first fluid outlet, and a low-pressure second fluid outlet. The integrated manifold system includes a low-pressure first fluid manifold coupled to each of the low-pressure first fluid inlets and configured to provide low-pressure first fluid to each of the low-pressure first fluid inlets, a high-pressure second fluid manifold coupled to each of the high-pressure second fluid inlets and configured to provide high-pressure second fluid to each of the high-pressure second fluid inlets, a high-pressure first fluid manifold coupled to each of the high-pressure first fluid outlets and configured to discharge high-pressure first fluid, and a low-pressure second fluid manifold coupled to each of the low-pressure second fluid outlets and configured to discharge low-pressure second fluid.

21 Claims, 7 Drawing Sheets

(51) Int. Cl.

| | |
|---|---|
| ***E21B 43/267*** | (2006.01) |
| ***F15D 1/06*** | (2006.01) |
| ***F17D 1/14*** | (2006.01) |
| ***F04F 13/00*** | (2009.01) |

(52) U.S. Cl.
CPC ..... *F04F 13/00* (2013.01); *F15D 1/06* (2013.01); *F17D 1/14* (2013.01); *Y10T 137/86139* (2015.04); *Y10T 137/86163* (2015.04)

(56) References Cited

U.S. PATENT DOCUMENTS

| | | | | |
|---|---|---|---|---|
| 2003/0049143 | A1* | 3/2003 | Takura | F04D 13/12<br>417/423.5 |
| 2009/0301725 | A1* | 12/2009 | Case | E21B 43/267<br>166/308.1 |
| 2012/0160336 | A1* | 6/2012 | Myran | B01D 61/06<br>137/14 |
| 2012/0181013 | A1 | 7/2012 | Kajaria et al. | |
| 2013/0284455 | A1 | 10/2013 | Kajaria et al. | |
| 2014/0128655 | A1 | 5/2014 | Arluck et al. | |

* cited by examiner

SYSTEM AND METHOD FOR UTILIZING INTEGRATED PRESSURE EXCHANGE MANIFOLD IN HYDRAULIC FRACTURING

CROSS-REFERENCE TO RELATED APPLICATIONS

This application is a non-provisional of U.S. Provisional Patent Application No. 62/030,816, entitled "SYSTEM AND METHOD FOR FLUID HANDLING", filed Jul. 30, 2014, which is herein incorporated by reference in its entirety.

BACKGROUND

This section is intended to introduce the reader to various aspects of art that may be related to various aspects of the present subject matter, which are described and/or claimed below. This discussion is believed to be helpful in providing the reader with background information to facilitate a better understanding of the various aspects of the present subject matter. Accordingly, it should be understood that these statements are to be read in this light, and not as admissions of prior art.

The subject matter disclosed herein relates to fluid handling, and, more particularly, to systems and methods for fluid handling using an isobaric pressure exchanger (IPX).

A variety of fluids may be used in the extraction of hydrocarbons from the earth. For example, hydraulic fracturing may refer to the fracturing of rock by a pressurized liquid, which may be referred to as a fracing fluid. The use of fracing fluids for hydraulic fracturing may increase the production of hydrocarbons from certain reservoirs. Typically, the fracing fluid may be introduced into the wellbore of a hydrocarbon reservoir at very high pressures by using high-pressure, high-volume pumps. Unfortunately, these pumps may undergo accelerated wear and erosion because of the properties of the fracing fluid and/or certain components of the fracing fluid, which may increase the cost to operate the pumps and/or decrease the efficiency of the hydraulic fracturing operation.

BRIEF DESCRIPTION OF THE DRAWINGS

Various features, aspects, and advantages of the present subject matter will become better understood when the following detailed description is read with reference to the accompanying figures in which like characters represent like parts throughout the figures, wherein.

DETAILED DESCRIPTION OF SPECIFIC EMBODIMENTS

Figure 1:
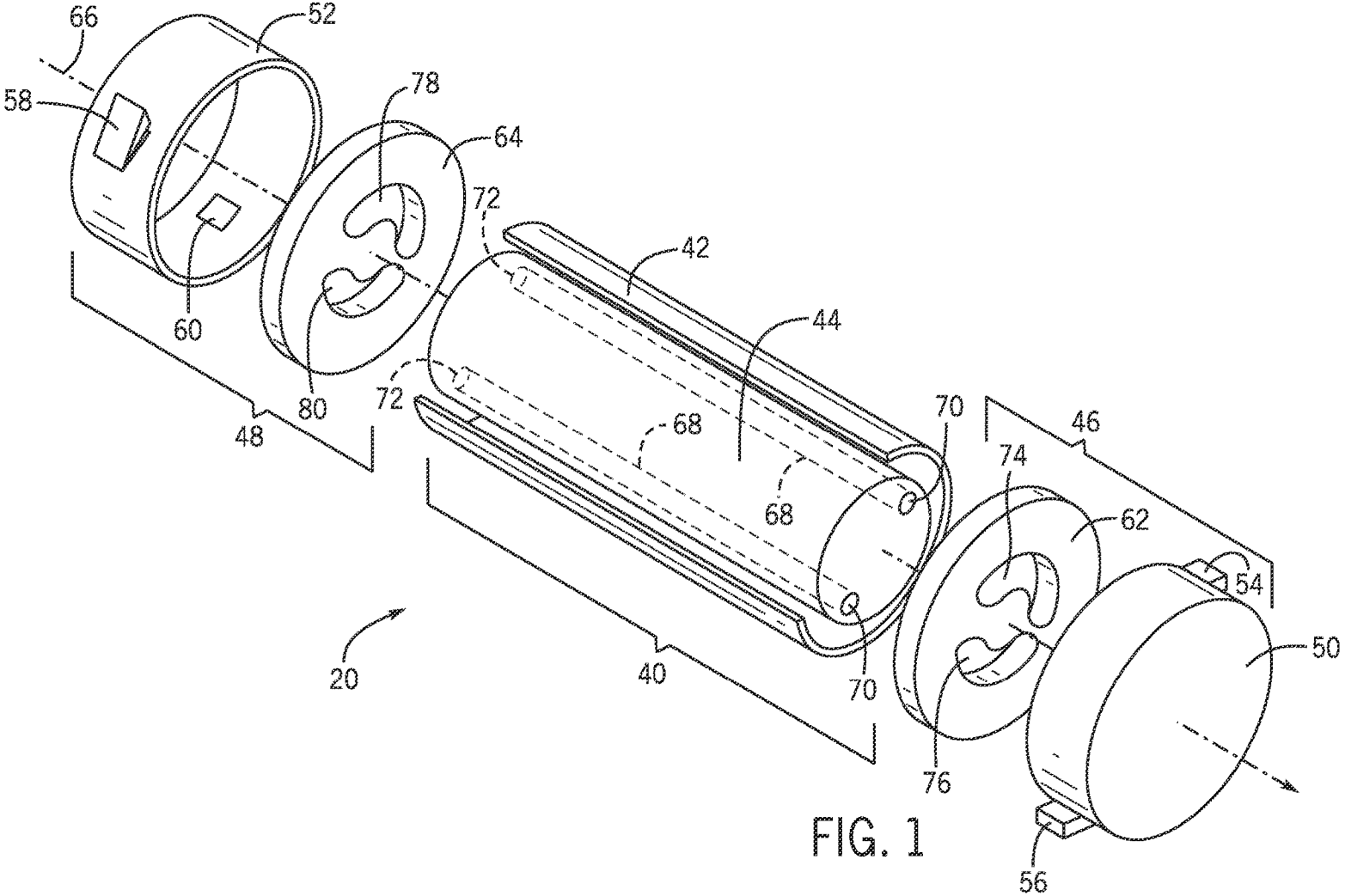
FIG. 1 is an exploded perspective view of an embodiment of a rotary isobaric pressure exchanger (IPX)

One or more specific embodiments of the present subject matter will be described below. These described embodiments are only exemplary of the present subject matter. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

As discussed in detail below, the disclosed embodiments relate generally to rotating equipment, and particularly to an isobaric pressure exchanger (IPX). For example, the IPX may handle a variety of fluids, some of which may be more viscous and/or abrasive than others. For example, the IPX can handle multi-phase (e.g., having at least two phases, where a phase is a region of space throughout which all physical properties of a material are essentially uniform) fluid flows, such as particle-laden liquid flows. An example of such a fluid includes, but is not limited to, the fracing fluid used in hydraulic fracturing. The fracing fluid may include water mixed with chemicals and small particles of hydraulic fracturing proppants, such as sand or aluminum oxide. The IPX may include chambers wherein the pressures of two volumes of a liquid may equalize, as described in detail below. In some embodiments, the pressures of the two volumes of liquid may not completely equalize. Thus, the IPX may not only operate isobarically, but also substantially isobarically (e.g., wherein the pressures equalize within approximately +/−1, 2, 3, 4, 5, 6, 7, 8, 9, or 10 percent of each other). In certain embodiments, a first pressure of a first fluid may be greater than a second pressure of a second fluid. For example, the first pressure may be between approximately 130 MPa to 160 MPa, 115 MPa to 180 MPa, or 100 MPa to 200 MPa greater than the second pressure. Thus, the IPX may be used to transfer pressure from the first fluid to the second fluid.

In certain situations, it may be desirable to use the IPX with viscous and/or abrasive fluids, such as fracing fluids. Specifically, the IPX or a plurality of IPXs may be used to handle these fluids instead of other equipment, such as the high-pressure, high-volume pumps used to inject fracing fluids into hydrocarbon reservoirs of other hydraulic fracturing operations. When used to pump fracing fluids, these high-pressure, high-volume pumps, which may be positive displacement pumps, may experience high rates of wear and erosion, resulting in short lives and high maintenance costs. In contrast, the components of the IPX may be more resistant to the effects of fracing fluids. Thus, in certain embodiments, the high-pressure, high-volume pumps may be used to pressurize a less viscous and/or less abrasive fluid, such as water (e.g., having a single phase), which is then used by the IPX to transfer pressure to the fracing fluid. In other words, the high-pressure, high-volume pumps of the present embodiments do not handle the pumping of the fracing fluids. Use of such embodiments may provide several advantages compared to other methods of handling fracing fluids. For example, such embodiments may help extend the life and/or reduce the operating costs of the high-pressure, high-volume pumps. By reducing downtime associated with the high-pressure, high-volume pumps, which may be very costly, the overall hydrocarbon production rate may be increased by increasing the life of the high-pressure pumps. In certain embodiments, an integrated manifold system (e.g., integrated pressure exchange manifold) may include a plurality of IPXs and one or more piping manifolds for handling the fracing fluid and/or water, which may be easily integrated with the high-pressure, high-volume pumps and other equipment associated with hydraulic fracturing operations. Specifically, such embodiments of the integrated manifold system may include a plurality of connections to interface with existing piping, hoses, and/or other equipment. These embodiments of the integrated manifold system may have a relatively small footprint, thereby reducing any added congestion to what may already be a congested hydraulic fracturing operation. In addition, the integrated manifold system may help simplify the operation of the hydraulic fracturing operation. Specifically, by placing numerous components, such as the plurality of IPXs and manifolds, on a single trailer, the complexity associated with handling and connecting the integrated manifold system to other components of the hydraulic fracturing operation may be reduced. In other words, the number of trailers or skids associated with the components of the integrated manifold system may be reduced to a single trailer. Thus, use of the disclosed embodiments may increase the hydrocarbon production rates of hydraulic fracturing operations while also decreasing costs associated with these operations.

FIG. 1 is an exploded view of an embodiment of a rotary IPX 20 that may be modified for use with viscous and/or abrasive fluids, such as fracing fluids. As used herein, the isobaric pressure exchanger (IPX) may be generally defined as a device that transfers fluid pressure between a high-pressure inlet stream and a low-pressure inlet stream at efficiencies in excess of approximately 50%, 60%, 70%, or 80% without utilizing centrifugal technology. In this context, high pressure refers to pressures greater than the low pressure. The low-pressure inlet stream of the IPX may be pressurized and exit the IPX at high pressure (e.g., at a pressure greater than that of the low-pressure inlet stream), and the high-pressure inlet stream may be depressurized and exit the IPX at low pressure (e.g., at a pressure less than that of the high-pressure inlet stream). Additionally, the IPX may operate with the high-pressure fluid directly applying a force to pressurize the low-pressure fluid, with or without a fluid separator between the fluids. Examples of fluid separators that may be used with the IPX include, but are not limited to, pistons, bladders, diaphragms and the like. In certain embodiments, isobaric pressure exchangers may be rotary devices. Rotary isobaric pressure exchangers (IPXs) 20, such as those manufactured by Energy Recovery, Inc. of San Leandro, Calif., may not have any separate valves, since the effective valving action is accomplished internal to the device via the relative motion of a rotor with respect to end covers, as described in detail below with respect to FIGS. 1-5. Rotary IPXs may be designed to operate with internal pistons to isolate fluids and transfer pressure with little mixing of the inlet fluid streams. Reciprocating IPXs may include a piston moving back and forth in a cylinder for transferring pressure between the fluid streams. Any IPX or plurality of IPXs may be used in the disclosed embodiments, such as, but not limited to, rotary IPXs, reciprocating IPXs, or any combination thereof. While the discussion with respect to certain embodiments of the integrated manifold system may refer to rotary IPXs, it is understood that any IPX or plurality of IPXs may be substituted for the rotary IPX in any of the disclosed embodiments. In addition, the IPX may be disposed on a skid separate from the other components of a fluid handling system, which may be desirable in situations in which the IPX is added to an existing fluid handling system.

In the illustrated embodiment of FIG. 1, the rotary IPX 20 may include a generally cylindrical body portion 40 that includes a housing 42 and a rotor 44. The rotor 44 may be used with the integrated manifold system, as described in detail below with respect to FIGS. 6-9. The rotary IPX 20 may also include two end structures 46 and 48 that include manifolds 50 and 52, respectively. Manifold 50 includes inlet and outlet ports 54 and 56 and manifold 52 includes inlet and outlet ports 60 and 58. For example, inlet port 54 may receive a high-pressure first fluid and the outlet port 56 may be used to route a low-pressure first fluid away from the IPX 20. Similarly, inlet port 60 may receive a low-pressure second fluid and the outlet port 58 may be used to route a high-pressure second fluid away from the IPX 20. The end structures 46 and 48 include generally flat end plates 62 and 64, respectively, disposed within the manifolds 50 and 52, respectively, and adapted for liquid sealing contact with the rotor 44. The rotor 44 may be cylindrical and disposed in the housing 42, and is arranged for rotation about a longitudinal axis 66 of the rotor 44. The rotor 44 may have a plurality of channels 68 extending substantially longitudinally through the rotor 44 with openings 70 and 72 at each end arranged symmetrically about the longitudinal axis 66. The openings 70 and 72 of the rotor 44 are arranged for hydraulic communication with the end plates 62 and 64, and inlet and outlet apertures 74 and 76, and 78 and 80, in such a manner that during rotation they alternately hydraulically expose liquid at high pressure and liquid at low pressure to the respective manifolds 50 and 52. The inlet and outlet ports 54, 56, 58, and 60, of the manifolds 50 and 52 form at least one pair of ports for high-pressure liquid in one end element 46 or 48, and at least one pair of ports for low-pressure liquid in the opposite end element, 48 or 46. The end plates 62 and 64, and inlet and outlet apertures 74 and 76, and 78 and 80 are designed with perpendicular flow cross sections in the form of arcs or segments of a circle.

With respect to the IPX 20, the plant operator has control over the extent of mixing between the first and second fluids, which may be used to improve the operability of the fluid handling system. For example, varying the proportions of the first and second fluids entering the IPX 20 allows the plant operator to control the amount of fluid mixing within the fluid handling system. Three characteristics of the IPX 20 that affect mixing are: the aspect ratio of the rotor channels 68, the short duration of exposure between the first and second fluids, and the creation of a liquid barrier (e.g., an interface) between the first and second fluids within the rotor channels 68. First, the rotor channels 68 are generally long and narrow, which stabilizes the flow within the IPX 20. In addition, the first and second fluids may move through the channels 68 in a plug flow regime with very little axial mixing. Second, in certain embodiments, at a rotor speed of approximately 1200 RPM, the time of contact between the first and second fluids may be less than approximately 0.15 seconds, 0.10 seconds, or 0.05 seconds, which again limits mixing of the streams 18 and 30. Third, a small portion of the rotor channel 68 is used for the exchange of pressure between the first and second fluids. Therefore, a volume of fluid remains in the channel 68 as a barrier between the first and second fluids. All these mechanisms may limit mixing within the IPX 20.

In addition, because the IPX 20 is configured to be exposed to the first and second fluids, certain components of the IPX 20 may be made from materials compatible with the components of the first and second fluids. In addition, certain components of the IPX 20 may be configured to be physically compatible with other components of the fluid handling system. For example, the ports 54, 56, 58, and 60 may comprise flanged connectors to be compatible with other flanged connectors present in the piping of the fluid handling system. In other embodiments, the ports 54, 56, 58, and 60 may comprise threaded or other types of connectors.

FIGS. 2-5 are exploded views of an embodiment of the rotary IPX 20 illustrating the sequence of positions of a single channel 68 in the rotor 44 as the channel 68 rotates through a complete cycle, and are useful to an understanding of the rotary IPX 20. It is noted that FIGS. 2-5 are simplifications of the rotary IPX 20 showing one channel 68 and the channel 68 is shown as having a circular cross-sectional shape. In other embodiments, the rotary IPX 20 may include a plurality of channels 68 (e.g., 2 to 100) with different cross-sectional shapes. Thus, FIGS. 2-5 are simplifications for purposes of illustration, and other embodiments of the rotary IPX 20 may have configurations different from that shown in FIGS. 2-5. As described in detail below, the rotary IPX 20 facilitates a hydraulic exchange of pressure between two liquids by putting them in momentary contact within a rotating chamber. In certain embodiments, this exchange happens at a high speed that results in very high efficiency with very little mixing of the liquids.

Figure 2:
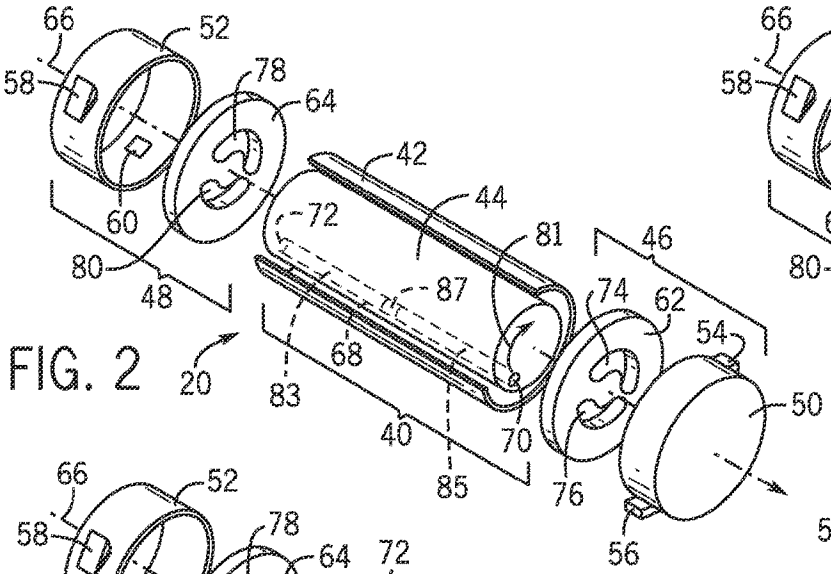
FIG. 2 is an exploded perspective view of an embodiment of a rotary IPX in a first operating position.

In FIG. 2, the channel opening 70 is in hydraulic communication with aperture 76 in endplate 62 and therefore with the manifold 50 at a first rotational position of the rotor 44 and opposite channel opening 72 is in hydraulic communication with the aperture 80 in endplate 64, and thus, in hydraulic communication with manifold 52. As discussed below, the rotor 44 rotates in the clockwise direction indicated by arrow 81. As shown in FIG. 2, low-pressure second fluid 83 passes through end plate 64 and enters the channel 68, where it pushes first fluid 85 out of the channel 68 and through end plate 62, thus exiting the rotary IPX 20. The first and second fluids 83 and 85 contact one another at an interface 87 where minimal mixing of the liquids occurs because of the short duration of contact. The interface 87 is a direct contact interface because the second fluid 83 directly contacts the first fluid 85.

Figure 3:
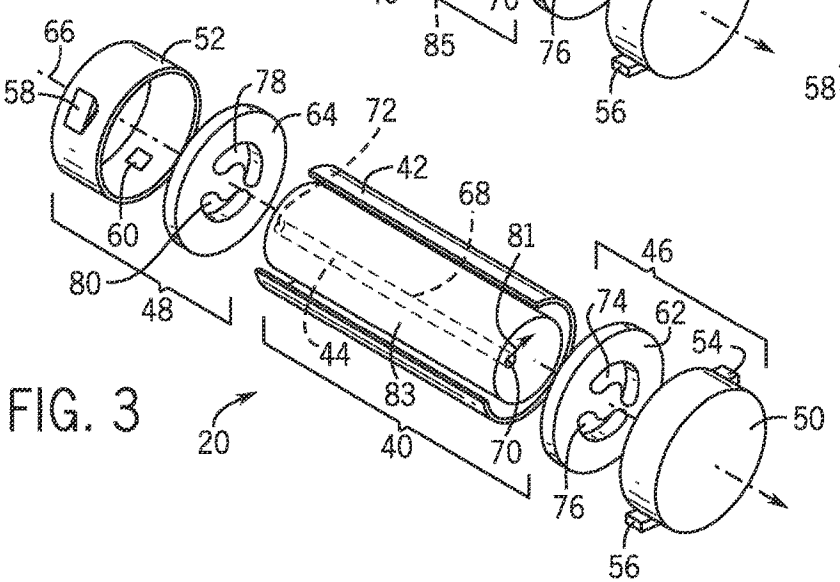
FIG. 3 is an exploded perspective view of an embodiment of a rotary IPX in a second operating position.

In FIG. 3, the channel 68 has rotated clockwise through an arc of approximately 90 degrees, and outlet 72 is now blocked off between apertures 78 and 80 of end plate 64, and outlet 70 of the channel 68 is located between the apertures 74 and 76 of end plate 62 and, thus, blocked off from hydraulic communication with the manifold 50 of end structure 46. Thus, the low-pressure second fluid 83 is contained within the channel 68.

Figure 4:
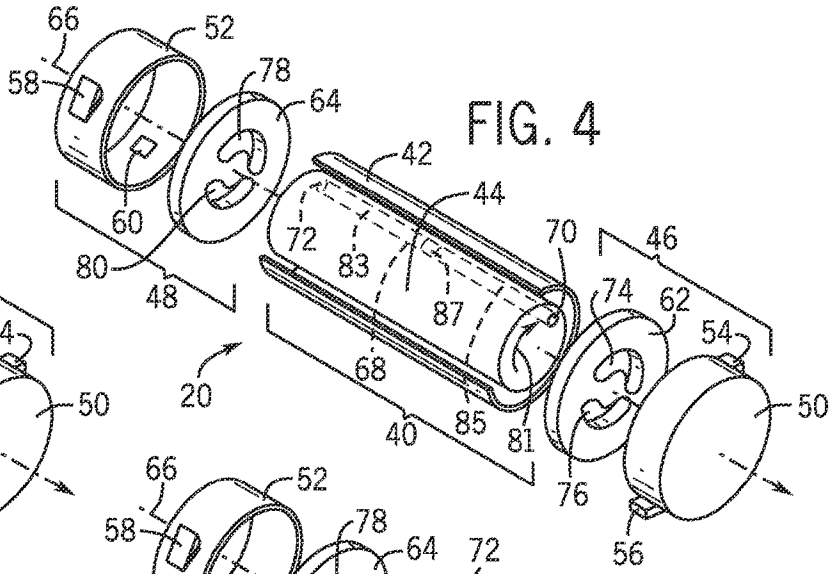
FIG. 4 is an exploded perspective view of an embodiment of a rotary IPX in a third operating position.

In FIG. 4, the channel 68 has rotated through approximately 180 degrees of arc from the position shown in FIG. 2. Opening 72 is in hydraulic communication with aperture 78 in end plate 64 and in hydraulic communication with manifold 52, and the opening 70 of the channel 68 is in hydraulic communication with aperture 74 of end plate 62 and with manifold 50 of end structure 46. The liquid in channel 68, which was at the pressure of manifold 52 of end structure 48, transfers this pressure to end structure 46 through outlet 70 and aperture 74, and comes to the pressure of manifold 50 of end structure 46. Thus, high-pressure first fluid 85 pressurizes and displaces the second fluid 83.

Figure 5:
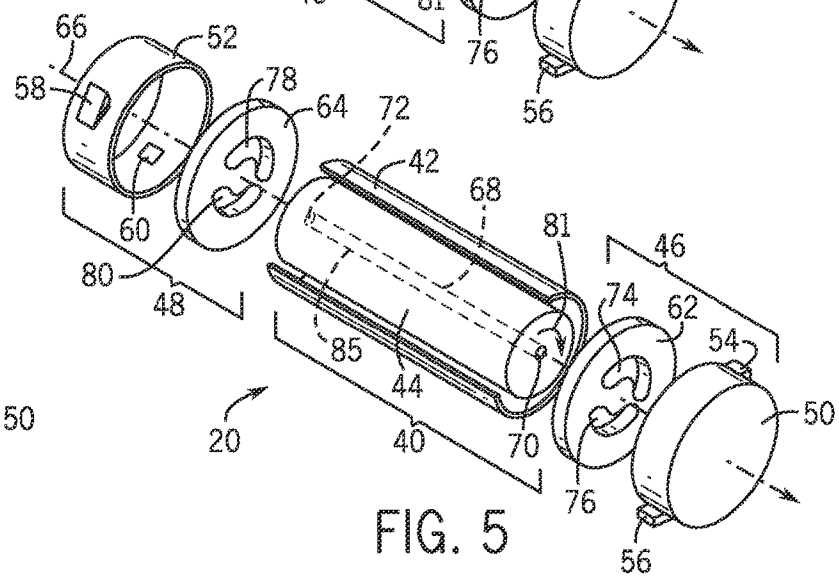
FIG. 5 is an exploded perspective view of an embodiment of a rotary IPX in a fourth operating position.

In FIG. 5, the channel 68 has rotated through approximately 270 degrees of arc from the position shown in FIG. 2, and the openings 70 and 72 of channel 68 are between apertures 74 and 76 of end plate 62, and between apertures 78 and 80 of end plate 64. Thus, the high-pressure first fluid 85 is contained within the channel 68. When the channel 68 rotates through approximately 360 degrees of arc from the position shown in FIG. 2, the second fluid 83 displaces the first fluid 85, restarting the cycle.

Figure 6:
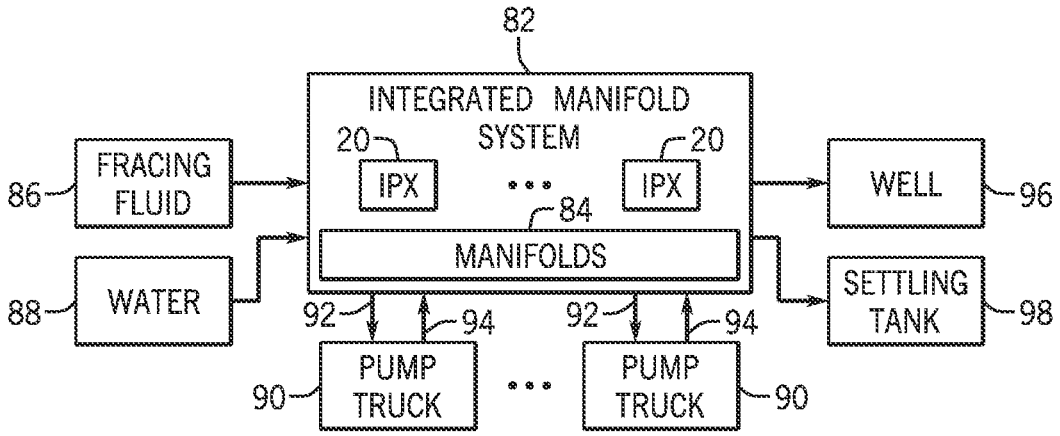
FIG. 6 is a schematic diagram of an embodiment of an integrated manifold system having a plurality of rotary IPXs that may be used in a hydraulic fracturing operation.

FIG. 6 is a schematic diagram of an embodiment of an integrated manifold system 82 having a plurality of rotary IPXs 20 (e.g., 4 to 20) that may be used in a hydraulic fracturing operation. The integrated manifold system is integrated by having the plurality of rotary IPXs 20 connected to one another via one or more manifolds (e.g., 2 to 20 segments of piping, tubing, conduits, and so forth connected to one another) as one assembly disposed on a skid or trailer that can be easily transported to and from the hydraulic fracturing operation. In certain embodiments, the manifolds may also include valves and other components, such as sensors. Each manifold may handle a separate fluid, such as the water or the fracing fluid, as described in detail below. Although the term water is used in the following discussion, in certain embodiments, any clean fluid (e.g., fluid substantially free of debris or solids or with substantially less debris or solids than the fracing fluid) may be used instead of water. In certain embodiments, water may also be referred to as "slick-water". Clean fluid may also include what is known in the industry as linear, cross-linked or hybrid Gel which could be water-based or oil-based. In certain embodiments, water may be combined with one or more of an oil, an acid, and a gelling agent. In addition, although the term fracing fluid is used in the following discussion, in certain embodiments, any fluid used in the production of oil and gas may be used instead of fracing fluid. Although the following discussion focuses on the use of the integrated manifold system 82 for hydraulic fracturing, certain embodiments of the integrated manifold system 82 may be used in similar applications in other oil and gas operations, mining operations, and so forth. As shown in FIG. 6, the plurality of rotary IPXs 20 (as indicated by horizontal dots) may be disposed within the integrated manifold system 82, which may include one or more manifolds 84 for handling water and/or fracing fluid, as described in detail below. Specifically, each of the rotary IPXs 20 may transfer pressure from a clean fluid (e.g., water) to the fracing fluid (e.g., mixture of water, chemicals, and proppant). The integrated manifold system 82 may be coupled to various components of the hydraulic fracturing operation. For example, fracing fluid 86 (e.g., first fluid) and water 88 (e.g., second fluid) may be supplied to the integrated manifold system 82 via tanks, vessels, pumps, blenders, conduits, pipes, hoses, and so forth. In addition, one or more pump trucks 90 (as indicated by horizontal dots) may be coupled to the integrated manifold system 82. Each pump truck 90 may include one or more high-pressure, high-volume pumps, such as positive displacement or plunger pumps. The pump trucks may be easily moved from one hydraulic fracturing site to another. As shown in FIG. 6, each pump truck may include an inlet connection 92 and an outlet connection 94 to provide a fluid, such as water, to the integrated manifold system 82 at a high pressure and high volume. As described below, by using the pump trucks 90 to handle water instead of the fracing fluid, the lives of the pump trucks 90 (e.g., particularly the high-pressure pumps) may be extended and operating costs reduced because the pump trucks 90 (e.g., particularly the high-pressure pumps) handle clean fluid (e.g. water) instead of the viscous and/or abrasive fracing fluid in the disclosed embodiments. As described in detail below, the rotary IPXs 20 may be used to transfer pressure from the high pressure clean fluid (e.g. water) produced by the pump trucks 90 to the fracing fluid. Thus, high-pressure, high-volume fracing fluid from the rotary IPXs 20 may be transferred to the well 96 or wellbore from the integrated manifold system 82 via conduits, pipes, hoses, and so forth. The low-pressure clean fluid (e.g. water) from the rotary IPXs 20, after transferring its energy to Frac fluid, may be transferred to a settling tank 98 to allow any solids or other materials to settle out of the water, before the water is recycled to the integrated manifold system 82 to be reused. In addition, the settling tank 98 may allow for heat generated by the pump trucks 90 to be dissipated. In other embodiments, the water from the settling tank 98 may be used in other areas of the hydraulic fracturing operation. In some embodiments, the water from the integrated manifold system 82 may be returned to a cooling pond, lake, river, or similar reservoir.

In certain embodiments, a method or process may be implemented for operating the integrated manifold system 82. Specifically, fracing fluid and water may be supplied to the integrated manifold system 82. Next, water may be pressurized by the plurality of pump trucks 90 and delivered to the plurality of rotary IPXs 20, where pressure from the high-pressure water is transferred to the fracing fluid. The high-pressure fracing fluid may be delivered from the integrated manifold system 82 to the well 96 and the low-pressure water returned to a settling tank 98.

Figure 7:
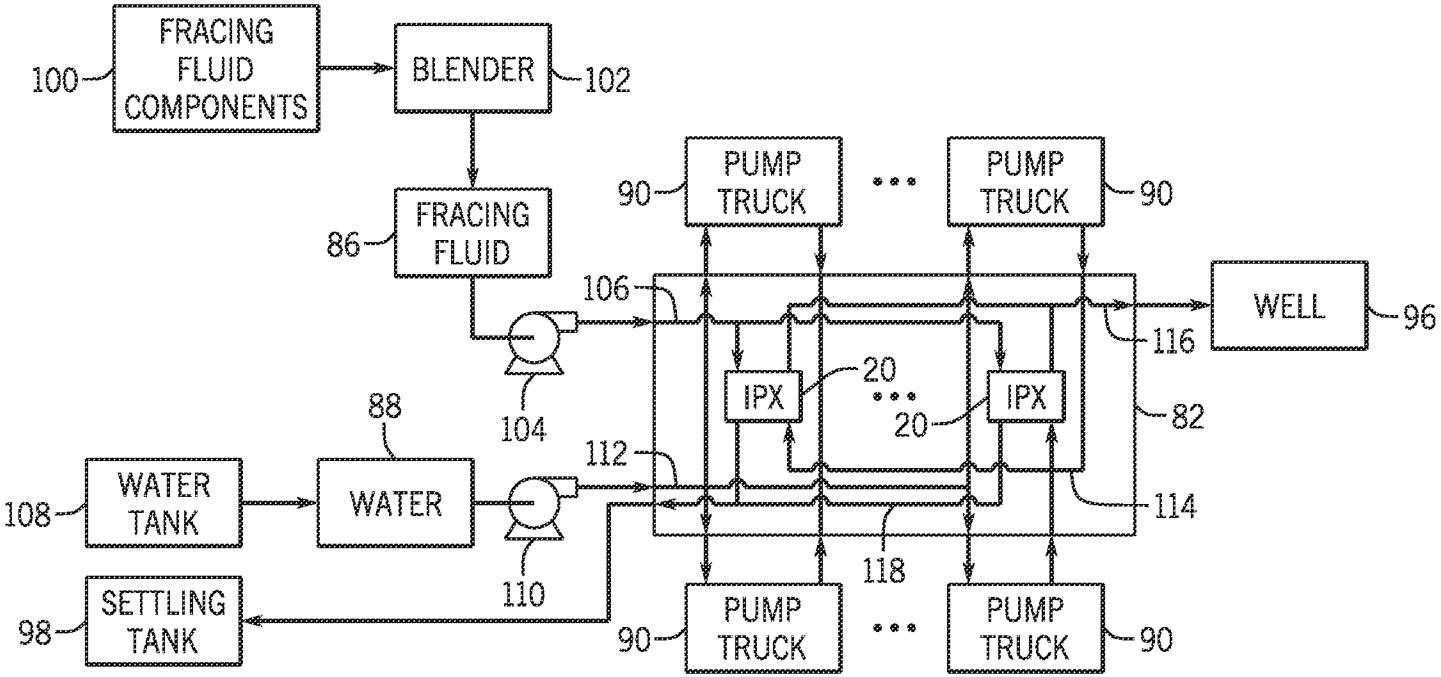
FIG. 7 is schematic diagram of an embodiment of an integrated manifold system having a plurality of rotary IPXs and both water and fracing fluid manifolds that may be used in a hydraulic fracturing operation.

FIG. 7 is schematic diagram of an embodiment of the integrated manifold system 82 having a plurality of rotary IPXs 20 and both water and fracing fluid manifolds that may be used in a hydraulic fracturing operation. As described in detail below, the integrated manifold system 82 may include the IPXs 20 and various manifolds, and may be disposed on a mobile transport unit (e.g., a trailer) to be easily transported to and from the hydraulic fracturing operation (i.e., to different locations). The various connections to and from the integrated manifold system 82 may be made using various conduits, pipes, hoses, and similar connections used in the hydraulic fracturing operation. As shown in FIG. 7, various fracing fluid components 100, such as, but not limited to, water (e.g, provided by the water tank or from the low-pressure water discharged from the IPXs 20), proppants, sand, ceramics, gelling agents, gels, foams, compressed gases, propane, liquefied petroleum gas, and various other chemical additives, may be supplied to a blender 102 to mix the components together to produce the fracing fluid 86. Thus, the fracing fluid 86 may be characterized as a two-phase (e.g., liquid and solid) fluid. In other embodiments, the blender 102 may be omitted and the various fracing fluid components 100 may arrive at the hydraulic fracturing operation already mixed together as the fracing fluid 86. As shown in FIG. 7, a fracing fluid pump 104, such as a centrifugal pump or other type of pump (e.g., reciprocating pump), may be used to transfer the fracing fluid 86 to the integrated manifold system 82. The fracing fluid 86 may arrive at the integrated manifold system 82 at a pressure between approximately 675 kPa and 1,400 kPa. The integrated manifold system 82 may include a low-pressure fracing fluid manifold 106 to transfer the fracing fluid 86 from the fracing fluid pump 104 to the plurality of rotary IPXs 20. Specifically, the low-pressure fracing fluid manifold 106 (e.g., one pipe, conduit or tubing or several segments coupled together) may be a conduit or other pipe with branches to each of the rotary IPXs 20.

As illustrated in FIG. 7, water 88 (e.g., clean fluid) may be supplied from a water tank 108, vessel, or other reservoir to a water pump 110 that transfers the water 88 to the integrated manifold system 82. In certain embodiments, the water pump 110 may be a centrifugal pump or another type of pump (e.g., reciprocating pump). The integrated manifold system 82 may include an inlet water manifold 112 to transfer the water 88 from the water pump 110 to each of the pump trucks 90 via separate connections for each pump truck 90. As shown in FIG. 7, the pump trucks 90 may be arranged along longitudinal or lengthwise sides of the integrated manifold system 82. Thus, the position of the integrated manifold system 82 between rows of pump trucks 90 may help reduce the overall footprint of the hydraulic fracturing operation and/or reduce any reconfiguration of the hydraulic fracturing operation. A plurality of pump trucks 90 may be used to obtain the high volumes, such as volumes between approximately 1500 liters per minute and 22,000 liters per minute, used for the hydraulic fracturing operation. In certain embodiments, the inlet water manifold 112 may be a conduit or other pipe with branches to each of the pump trucks 90. As described above, each pump truck 90 may include one or more high-pressure, high-volume pumps to increase the pressure of the water 88 to a water pressure between approximately 130 MPa to 160 MPa, 115 MPa to 180 MPa, or 100 MPa to 200 MPa greater than a fracing fluid pressure of the fracing fluid 86 from the fracing pump 104. In contrast to other hydraulic fracturing operations, the pump trucks 90 of the disclosed embodiments handle water 88 instead of the fracing fluid 86. In other words, the pump trucks 90 are isolated from the fracing fluid 86. Thus, the pump trucks 90 of the disclosed embodiments are less susceptible to downtime caused by the viscous and/or abrasive fracing fluid 86. Thus, the throughput of the disclosed hydraulic fracturing operations that utilize the integrated manifold system 82 may be increased and operating costs decreased compared to other hydraulic fracturing operations that do not include the integrated manifold system 82 by increasing the life of the high-pressure pumps, which may be very costly. The high-pressure water 88 from the pump trucks 90 returns to the integrated manifold system 82 and enters a high-pressure water manifold 114, which may be a conduit or other pipe with branches to each of the rotary IPXs 20.

As described in detail above, each of the plurality of IPXs 20 transfers pressure from the high-pressure water 88 in the high-pressure water manifold 114 to the fracing fluid 86 in the low-pressure fracing fluid manifold 106. The high-pressure fracing fluid 86 from each of the plurality of IPXs 20 is combined in a high-pressure fracing fluid manifold 116 of the integrated manifold system 82. The high-pressure fracing fluid 86 may be conveyed from the integrated manifold system 82 to the well 96 using conduits, pipes, or hoses. Once introduced into the well 96, the high-pressure fracing fluid 86 may be used to stimulate the production of hydrocarbons from the well 96.

As shown in FIG. 7, the low-pressure water 88 from each of the plurality of IPXs 20 is combined in a low-pressure water manifold 118 of the integrated manifold system 82. The low-pressure water 88 may be conveyed from the integrated manifold system 82 to the settling tank 98 using conduits, pipes, or hoses. As described above, the low-pressure water 88 from the integrated manifold system 82 may be returned to ponds, lakes, basins, or other reservoirs in certain embodiments.

Figure 8:
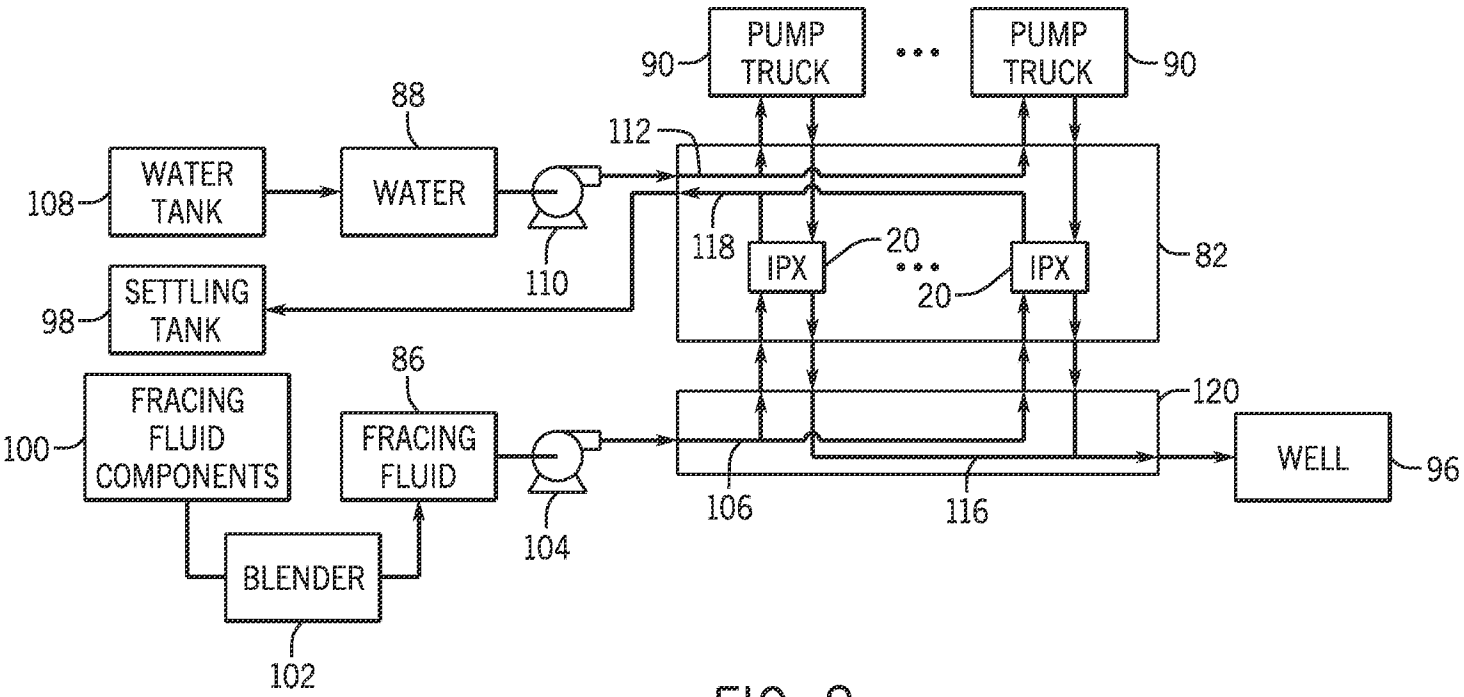
FIG. 8 is schematic diagram of an embodiment of an integrated manifold system having a plurality of rotary IPXs and water manifolds that may be used in a hydraulic fracturing operation.

FIG. 8 is schematic diagram of an embodiment of the integrated manifold system 82 having a plurality of rotary IPXs 20 and water manifolds that may be used in a hydraulic fracturing operation. Certain components of the embodiment shown in FIG. 8 are similar to those shown in FIG. 7. For example, water 88 is supplied to the integrated manifold system 82 using the water pump 110 and returned to the settling tank 98. In addition, the plurality of pump trucks 90 are coupled to the integrated manifold system 82 and used to increase the pressure of the water 88 delivered to the plurality of rotary IPXs 20 disposed in the integrated manifold system 82. However, in certain embodiments, the low-pressure fracing fluid manifold 106 and the high-pressure fracing fluid manifold 116 may be disposed in a manifold trailer 120 (or skid) separate from the integrated manifold system 82 that includes the water manifolds 112, 118. Thus, the fracing fluid 86 from the fracing pump 104 may be delivered initially to the manifold trailer 120. From there, the low-pressure fracing fluid 86 may be transferred to the integrated manifold system 82 via conduits, pipes, hoses, and so forth. Specifically, the low-pressure fracing fluid manifold 106 may include separate branches to each of the plurality of rotary IPXs 20 of the integrated manifold system 82. Similarly, the high-pressure fracing fluid 86 from each of the plurality of rotary IPXs 20 may be delivered via separate branches to the high-pressure fracing fluid manifold 116 of the manifold trailer 120. From there, the high-pressure fracing fluid 86 may be delivered to the well 96. Separating the low-pressure and high-pressure fracing fluid manifolds 106, 116 from the integrated manifold system 82 may provide additional flexibility in the arrangement of equipment at certain hydraulic fracturing operations. In other embodiments, the water 112, 118 and fracing fluid manifolds 106, 116 may be arranged differently. For example, the integrated manifold system 82 may only include the low-pressure and high-pressure fracing fluid manifolds 106, 116 and not the water manifolds 112, 118. In certain embodiments, the fracing fluid manifolds 106, 116 may be disposed on a first trailer, the water manifolds 112, 118 on a second trailer, and the plurality of rotary IPXs 20 on a third trailer. Other arrangements of manifolds and rotary IPXs 20 are possible in further embodiments.

Figure 9:
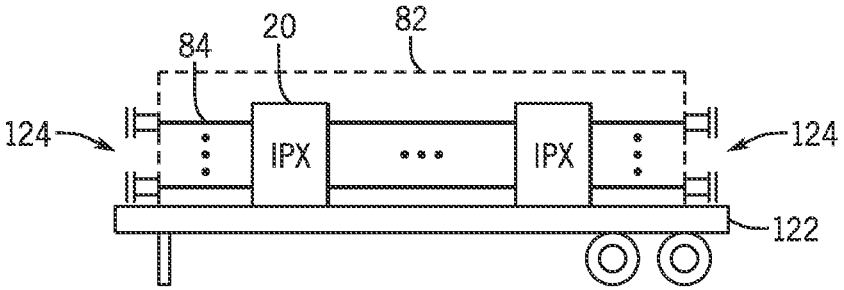
FIG. 9 is a side view of an embodiment of an integrated manifold system having a plurality of rotary IPXs mounted on a trailer.

FIG. 9 is a side view of an embodiment of the integrated manifold system 82 having the plurality of rotary IPXs 20 mounted on a trailer 122 (e.g., mobile transport unit). The integrated manifold system 82 may include any of the embodiments of the integrated manifold system 82 described in detail above. For example, the integrated manifold system 82 may include the plurality of rotary IPXs 20 connected to one another via one or more manifolds (e.g., 2 to 20 segments of piping, tubing, conduits, and so forth connected to one another) as one assembly disposed on the trailer 122. As shown in FIG. 9, the various components of the integrated manifold system 82 are represented as being enclosed by or coupled to the dashed box. In certain embodiments, these components may be surrounded by a physical enclosure to protect the components from the weather and environment. In other embodiments, no enclosure is provided and the various components of the integrated manifold system 82 may be designed to be exposed to the weather and environment. The trailer 122 may be of an appropriate length and weight rating for supporting and transporting the integrated manifold system 82. In addition, one or more connections 124 may be provided to couple to the various manifolds 84 of the integrated manifold system 82. Examples of connections 124 that may be used include, but are not limited to, flanged, screwed, threaded, hammer-union, and so forth. By providing the integrated manifold system 82 on the trailer 122, the integrated manifold system 82 may be easily transported from one hydraulic fracturing operation to another. In addition, by placing the components of the integrated manifold system 82 on the trailer 122, the footprint occupied by the integrated manifold system 82 may be reduced. In other words, the components of the integrated manifold system 82 are concentrated on one trailer 122 compared to being spread out over several trailers or skids. Thus, use of the integrated manifold system 82 may be easily integrated into many existing hydraulic fracturing operations.

Figure 10:
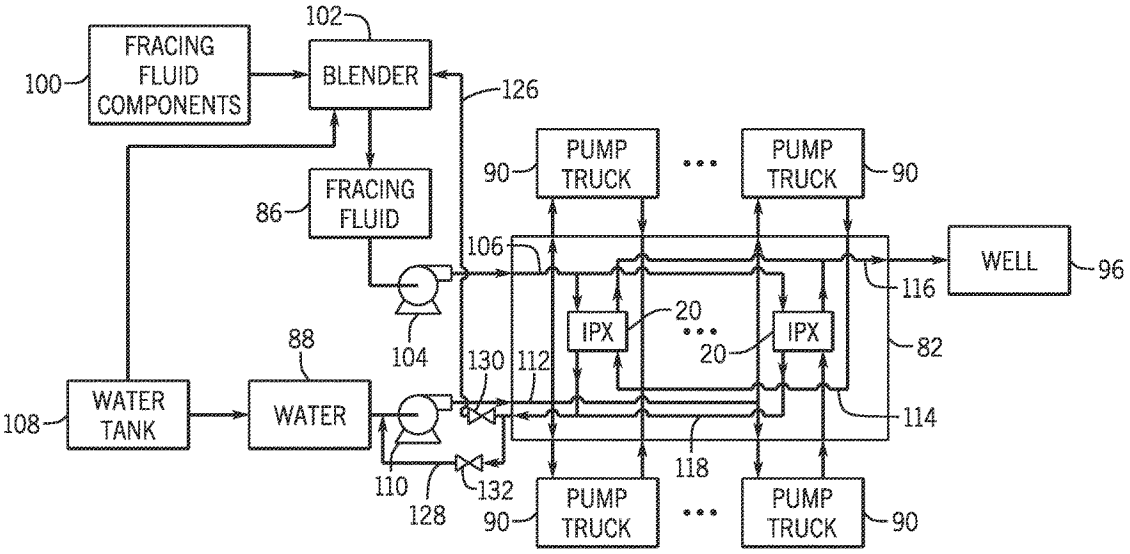
FIG. 10 is a schematic diagram of an embodiment of an integrated manifold system having a plurality of rotary IPXs that may be used in a hydraulic fracturing operation (e.g., returning at least a portion of a discharged low-pressure water to a blender)

FIG. 10 is a schematic diagram of an embodiment of the integrated manifold system 82 having the plurality of rotary IPXs 20 that may be used in a hydraulic fracturing operation (e.g., returning at least a portion of a discharged low-pressure water to the blender 102). In general, the integrated manifold system 82 and components of the associated hydraulic fracturing operation are as described above (e.g., FIG. 7) except the low-pressure water discharged from the rotary IPXs 20 into the low-pressure water manifold 118 is fully or partially directed to the blender 102 to be mixed with the fracing fluid 86 instead of the settling tank 98. For example, the discharged low-pressure water may be directed along fluid conduit 126 to the blender 102 and/or fluid conduit 128 to be returned upstream of the water pump 110 to be transferred to the water inlet manifold 112. As depicted, the fluid conduit conduits 126, 128 each include a respective valve 130, 132 (e.g., fluid control valves) to regulate how much of the discharged low-pressure water is directed to the blender 102. The ratio of discharged low-pressure water diverted to the blender 102 versus upstream of the water pump 110 may depend upon the capacity of the blender (e.g., in order to avoid overflowing the blender 102). In certain embodiments, the percentage of discharged low-pressure water diverted to the blender 102 (as opposed to upstream of the water pump 110) may range from approximately 0 to 100 percent, 0 to 25 percent, 25 to 50 percent, 50 to 75 percent, 75 to 100 percent, and all subranges therebetween. For example, the percentage of discharged low-pressure water diverted to the blender 102 may be approximately 10, 20, 30, 40, 50, 60, 70, 80, 90, or 100 percent.

Figure 11:
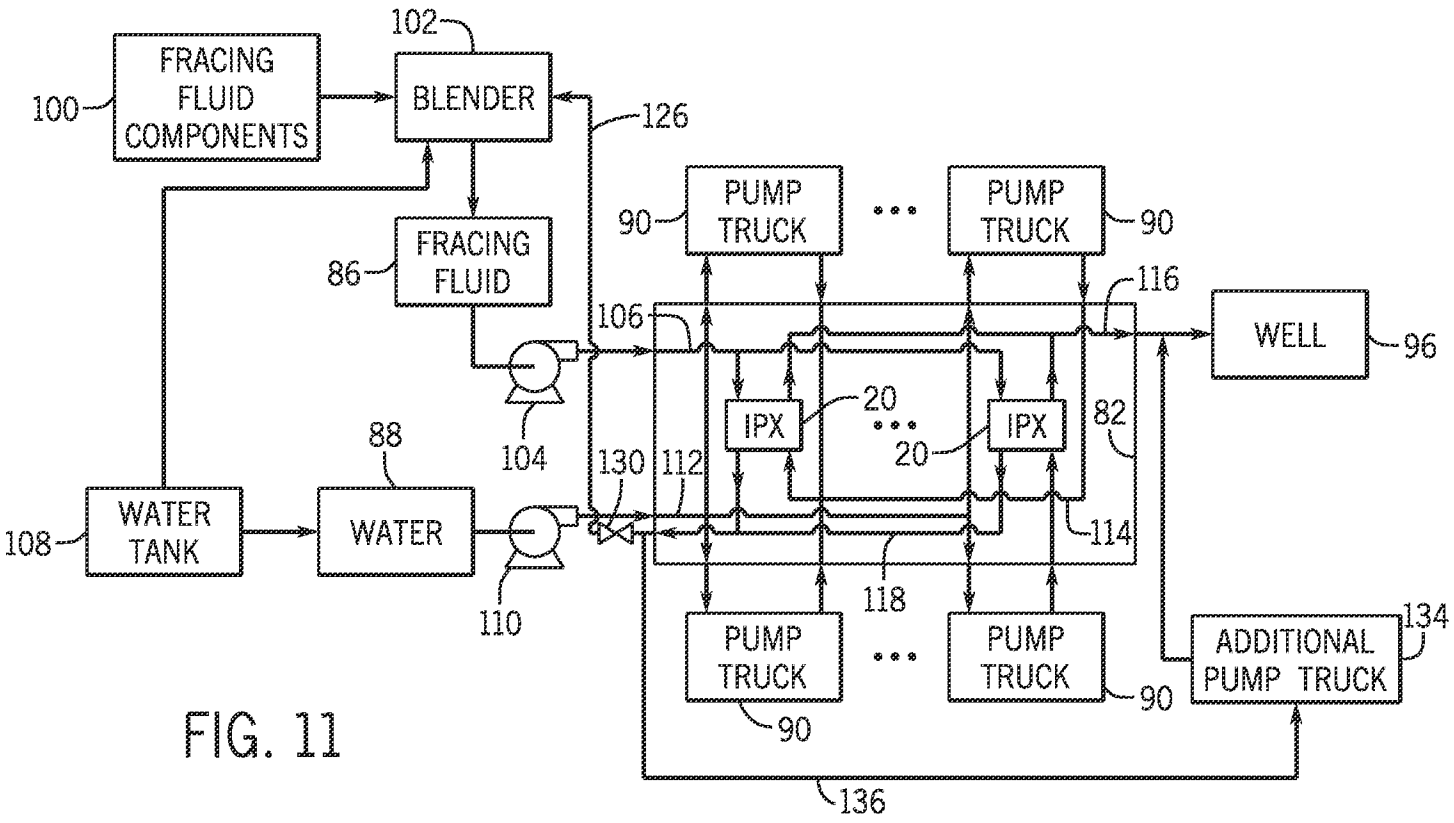
FIG. 11 is a schematic diagram of an embodiment of an integrated manifold system having a plurality of rotary IPXs that may be used in a hydraulic fracturing operation (e.g., repressurizing a portion of a discharge low-pressure water for use in a well).

FIG. 11 is a schematic diagram of an embodiment of the integrated manifold system 82 having the plurality of rotary IPXs 20 that may be used in a hydraulic fracturing operation (e.g., re-pressurizing a portion of a discharge low-pressure second fluid for use in a well). In general, the integrated manifold system 82 and components of the associated hydraulic fracturing operation are as described above (e.g., FIG. 7) except the low-pressure water discharged from the rotary IPXs 20 into the low-pressure water manifold 118 is fully or partially directed to one or more additional pump trucks 134 for transfer to the well 96 instead of the settling tank 98. For example, the discharged low-pressure water may be directed along fluid conduit 126 to the blender 102 and/or fluid conduit 136 to be provided to the additional pump trucks 136. The additional pump trucks 134 are similar to the pump trucks 90 described above. The pumps on the additional pump trucks 136 pressurize the discharged water and provide the re-pressurized water to the high-pressure fracing fluid flowing from the high-pressure fracing fluid manifold 116 upstream of the well 96. As depicted, the fluid conduit conduits 126 includes a valve 130 to regulate a ratio of the discharged low-pressure water directed to the blender 102 and the additional pump trucks 134, respectively. The ratio of discharged low-pressure water diverted to the blender 102 versus the additional pump trucks 134 may vary. In certain embodiments, the percentage of discharged low-pressure water diverted to the blender 102 (as opposed to upstream of the water pump 110) may range from approximately 75 to 100 percent. For example, the percentage of discharged low-pressure water diverted to the blender 102 may be approximately 75, 80, 85, 90, 95 or 100 percent.

While the subject matter may be susceptible to various modifications and alternative forms, specific embodiments have been shown by way of example in the drawings and have been described in detail herein. However, it should be understood that the subject matter is not intended to be limited to the particular forms disclosed. Rather, the subject matter is to cover all modifications, equivalents, and alternatives falling within the spirit and scope of the subject matter as defined by the following appended claims.

What is claimed is:

1. A system, comprising:

an integrated manifold system, comprising:

a plurality of isobaric pressure exchangers (IPXs), wherein each IPX of the plurality of IPXs comprises a low-pressure first fluid inlet configured to receive a low-pressure first fluid, a high-pressure second fluid inlet configured to receive a high-pressure second fluid, a high-pressure first fluid outlet configured to discharge a high-pressure first fluid, and a low-pressure second fluid outlet configured to discharge a low-pressure second fluid;

a low-pressure first fluid manifold coupled to each of the low-pressure first fluid inlets of the plurality of IPXs and configured to provide the low-pressure first fluid to each of the low-pressure first fluid inlets of the plurality of IPXs;

a high-pressure second fluid manifold coupled to each of the high-pressure second fluid inlets of the plurality of IPXs and configured to provide the high-pressure second fluid to each of the high-pressure second fluid inlets of the plurality of IPXs;

a high-pressure first fluid manifold coupled to each of the high-pressure first fluid outlets of the plurality of IPXs and configured to discharge the high-pressure first fluid from the integrated manifold system; and a low-pressure second fluid manifold coupled to each of the low-pressure second fluid outlets of the plurality of IPXs and configured to discharge the low-pressure second fluid from the integrated manifold system;

wherein the first fluid comprises a fracing fluid having proppants, and the system comprises a blender coupled to the low-pressure first fluid manifold and configured to produce the fracing fluid, and wherein the blender is coupled to a fluid conduit configured to divert at least a portion of the low-pressure second fluid discharged from the low-pressure second fluid manifold to the blender.

2. The system of claim 1, wherein the second fluid comprises one or more of water, an oil, an acid, and a gelling agent, and the second fluid lacks proppants.

3. The system of claim 1, wherein the plurality of isobaric pressure exchangers is configured to utilize the high-pressure second fluid to increase a pressure of the low-pressure first fluid.

4. The system of claim 1, comprising a plurality of pumps coupled to the high-pressure second fluid manifold, wherein the plurality of pumps is configured to receive the low-pressure second fluid, to increase a pressure of the low-pressure second fluid to the high-pressure second fluid, and to provide the high-pressure second fluid to the high-pressure second fluid manifold.

5. The system of claim 4, wherein the plurality of pumps are configured to be isolated from the first fluid.

6. The system of claim 4, wherein the integrated manifold system comprises an inlet second fluid manifold coupled to a second fluid pump and configured to provide the low-pressure second fluid to the plurality of pumps.

7. The system of claim 1, comprising a mobile transport unit, and the integrated manifold system is disposed on the mobile transport unit, and the mobile transport unit is configured to transport the integrated manifold system to different locations.

8. The system of claim 1, comprising a fluid conduit coupled to the low-pressure second fluid manifold, wherein the fluid conduit is configured to divert at least a portion of the low-pressure second fluid discharged from the low-pressure second fluid manifold to at least one pump, and wherein the at least one pump is configured to increase the pressure of the low-pressure second fluid to a re-pressurized high-pressure second fluid and to provide the re-pressurized high-pressure second fluid into the high-pressure first fluid discharged from the high-pressure first fluid manifold.

9. A system, comprising:

an integrated manifold system, comprising:

a plurality of isobaric pressure exchangers (IPXs), wherein each IPX of the plurality of IPXs comprises a low-pressure first fluid inlet configured to receive a low-pressure first fluid, a high-pressure second fluid inlet configured to receive a high-pressure second fluid, a high-pressure first fluid outlet configured to discharge a high-pressure first fluid, and a low-pressure second fluid outlet configured to discharge a low-pressure second fluid;

a high-pressure second fluid manifold coupled to each of the high-pressure second fluid inlets of the plurality of IPXs and configured to provide the high-pressure second fluid to each of the high-pressure second fluid inlets of the plurality of IPXs; and a low-pressure second fluid manifold coupled to each of the low-pressure second fluid outlets of the plurality of IPXs and configured to discharge the low-pressure second fluid from the integrated manifold system; and an additional manifold system separate from the integrated manifold system, comprising:

a low-pressure first fluid manifold coupled to each of the low-pressure first fluid inlets of the plurality of IPXs and configured to provide the low-pressure first fluid to each of the low-pressure first fluid inlets of the plurality of IPXs; and a high-pressure first fluid manifold coupled to each of the high-pressure first fluid outlets of the plurality of IPXs and configured to discharge the high-pressure first fluid from the integrated manifold system; and a fluid conduit coupled to the low-pressure second fluid manifold, wherein the fluid conduit is configured to divert at least a portion of the low-pressure second fluid discharged from the low-pressure second fluid manifold to at least one pump, and wherein the at least one pump is configured to increase the pressure of the low-pressure second fluid to a re-pressurized high-pressure second fluid and to provide the re-pressurized high-pressure second fluid into the high-pressure first fluid discharged from the high-pressure first fluid manifold.

10. The system of claim 9, comprising a first trailer and a second trailer, wherein the integrated manifold system is disposed on the first trailer, and the additional manifold system is disposed on the second trailer.

11. The system of claim 9, wherein the first fluid comprises a fracing fluid having proppants and the additional manifold system comprises a fracing fluid manifold system configured to receive a low-pressure fracing fluid from a fracing fluid pump.

12. The system of claim 11, wherein the fracing fluid manifold system is configured to provide the low-pressure fracing fluid to the plurality of IPXs of the integrated manifold system via the low-pressure first fluid manifold, to receive a high-pressure fracing fluid from the integrated manifold the plurality of IPXs of the integrated manifold system, and to discharge the high-pressure to fracing fluid via the high-pressure first fluid manifold.

13. The system of claim 9, wherein the plurality of isobaric pressure exchangers is configured to utilize the high-pressure second fluid to increase a pressure of the low-pressure first fluid.

14. The system of claim 9, comprising a plurality of pumps coupled to the high-pressure second fluid manifold, wherein the plurality of pumps is configured to receive the low-pressure second fluid, to increase a pressure of the low-pressure second fluid to the high-pressure second fluid, and to provide the high-pressure second fluid to the high-pressure second fluid manifold.

15. The system of claim 14, wherein the plurality of pumps are configured to be isolated from the first fluid.

16. The system of claim 14, wherein the integrated manifold system comprises an inlet second fluid manifold coupled to a second fluid pump and configured to provide the low-pressure second fluid to the plurality of pumps.

17. A method, comprising:

flowing a low-pressure first fluid through a low-pressure first fluid manifold into respective low-pressure first fluid inlets of a plurality of isobaric pressure exchangers (IPXs);

flowing a high-pressure second fluid through a high-pressure second fluid manifold into respective high-pressure second fluid inlets of the plurality of IPXs;

pressurizing the low-pressure first fluid to a high-pressure second fluid within the plurality of IPXs via the high-pressure second fluid;

flowing a high-pressure first fluid out of respective high-pressure first fluid outlets of the plurality of IPXs into a high-pressure first fluid manifold; and flowing a low-pressure second fluid out of respective low-pressure second fluid outlets of the plurality of IPXs into a low-pressure second fluid manifold, wherein the first fluid comprises a fracing fluid having proppants;

diverting, via a fluid conduit, at least a portion of the low-pressure second fluid from the low-pressure second fluid manifold to a blender coupled to the low-pressure first fluid manifold and configured to produce the fracing fluid;

wherein the low-pressure first fluid manifold, the high-pressure first fluid manifold, the low-pressure second fluid manifold, the high-pressure second fluid manifold, and the plurality of IPXs form an integrated pressure exchange module.

18. The method of claim 17, comprising flowing the low-pressure second fluid through a plurality of pumps to pressurize the low-pressure second fluid to a high-pressure second fluid prior to flowing the high-pressure second fluid through the high-pressure second fluid manifold into the respective high-pressure second fluid inlets of the plurality of IPXs.

19. The method of claim 18, wherein the second fluid comprises one or more of water, an oil, an acid, and a gelling agent, and the second fluid lacks proppants.

20. A system, comprising:

an integrated manifold system, comprising:

a plurality of isobaric pressure exchangers (IPXs), wherein each IPX of the plurality of IPXs comprises a low-pressure first fluid inlet configured to receive a low-pressure first fluid, a high-pressure second fluid inlet configured to receive a high-pressure second fluid, a high-pressure first fluid outlet configured to discharge a high-pressure first fluid, and a low-pressure second fluid outlet configured to discharge a low-pressure second fluid;

a low-pressure first fluid manifold coupled to each of the low-pressure first fluid inlets of the plurality of IPXs and configured to provide the low-pressure first fluid to each of the low-pressure first fluid inlets of the plurality of IPXs;

a high-pressure second fluid manifold coupled to each of the high-pressure second fluid inlets of the plurality of IPXs and configured to provide the high-pressure second fluid to each of the high-pressure second fluid inlets of the plurality of IPXs;

a high-pressure first fluid manifold coupled to each of the high-pressure first fluid outlets of the plurality of IPXs and configured to discharge the high-pressure first fluid from the integrated manifold system;

a low-pressure second fluid manifold coupled to each of the low-pressure second fluid outlets of the plurality of IPXs and configured to discharge the low-pressure second fluid from the integrated manifold system; and a fluid conduit coupled to the low-pressure second fluid manifold, wherein the fluid conduit is configured to divert at least a portion of the low-pressure second fluid discharged from the low-pressure second fluid manifold to at least one pump, and wherein the at least one pump is configured to increase the pressure of the low-pressure second fluid to a re-pressurized high-pressure second fluid and to provide the re-pressurized high-pressure second fluid into the high-pressure first fluid discharged from the high-pressure first fluid manifold.

21. A method, comprising:

flowing a low-pressure first fluid through a low-pressure first fluid manifold into respective low-pressure first fluid inlets of a plurality of isobaric pressure exchangers (IPXs);

flowing a high-pressure second fluid through a high-pressure second fluid manifold into respective high-pressure second fluid inlets of the plurality of IPXs;

pressurizing the low-pressure first fluid to a high-pressure second fluid within the plurality of IPXs via the high-pressure second fluid;

flowing a high-pressure first fluid out of respective high-pressure first fluid outlets of the plurality of IPXs into a high-pressure first fluid manifold; and flowing a low-pressure second fluid out of respective low-pressure second fluid outlets of the plurality of IPXs into a low-pressure second fluid manifold; and diverting, via a fluid conduit coupled the low-pressure second fluid manifold, at least a portion of the low-pressure second fluid from the low-pressure second fluid manifold to at least one pump;

increasing, via the at least one pump, the pressure of the low-pressure second fluid to a re-pressurized high pressure second fluid;

flowing the re-pressurized high-pressure second fluid into the high-pressure first fluid discharged from the high-pressure first fluid manifold;

wherein the low-pressure first fluid manifold, the high-pressure first fluid manifold, the low-pressure second fluid manifold, the high-pressure second fluid manifold, and the plurality of IPXs form an integrated pressure exchange module.

* * * * *